United States Patent [19]

Legrand

[11] 4,400,671

[45] Aug. 23, 1983

[54] MAGNETICALLY CONTROLLED MERCURY WETTED SWITCH AND ELECTRICAL RELAY INCORPORATING SUCH A SWITCH

[75] Inventor: Jacques Legrand, Paris, France

[73] Assignee: Thomson-CSF, Paris, France

[21] Appl. No.: 222,887

[22] Filed: Jan. 6, 1981

[30] Foreign Application Priority Data

Jan. 8, 1980 [FR] France ..... 80 00308

[51] Int. Cl.[3] ..... H01H 29/00

[52] U.S. Cl. ..... 335/56; 335/58

[58] Field of Search ..... 335/47, 48, 55, 57, 335/58, 56

[56] References Cited

U.S. PATENT DOCUMENTS

| | | | |
|---|---|---|---|
| 2,247,493 | 7/1941 | Harrison et al. | 335/48 |
| 2,564,081 | 8/1951 | Schilling | 335/56 |
| 3,529,268 | 9/1970 | Rauterberg | 335/56 |
| 4,236,129 | 11/1980 | Lacis et al. | 335/58 |
| 4,238,748 | 12/1980 | Goullin et al. | 335/58 |

*Primary Examiner*—George Harris

[57] ABSTRACT

A mercury wetted switch, controlled by a magnetic field produced from a discret semiconductor encapsulating box or case, whose base has a double or so-called "common" electrode and at least one other insulated electrode. A moving plate engages in fork-like manner in the double electrode and bears against another electrode. The liquid wetting the contacts forms a liquid hinge for the plate on the double electrode.

Application to electrical relays, particularly for professional equipment and telecommunications.

9 Claims, 6 Drawing Figures

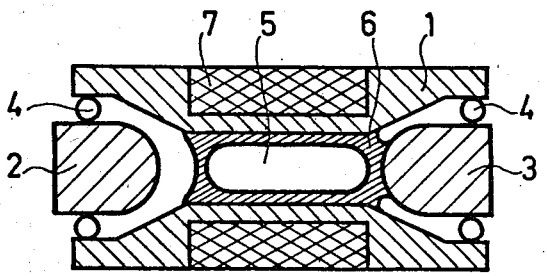
FIG.1
PRIOR ART
FIG.2
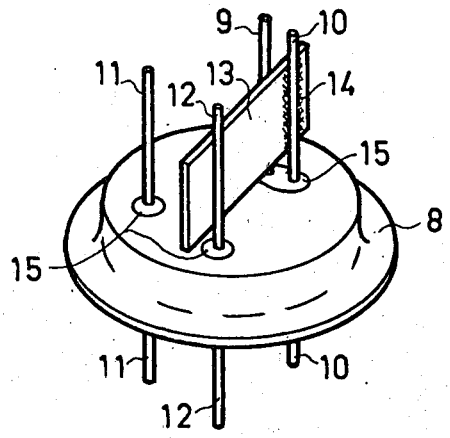
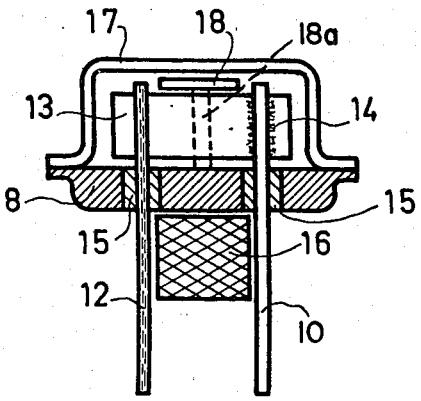
FIG.3

MAGNETICALLY CONTROLLED MERCURY WETTED SWITCH AND ELECTRICAL RELAY INCORPORATING SUCH A SWITCH

BACKGROUND OF THE INVENTION

The invention relates to a magnetically controlled switch with contacts wetted by a conductive liquid.

Switches with contacts wetted by a conductive liquid, generally in the form of mercury or a mercury amalgam are known in the art and are normally called mercury wetted switches. This category of electrical switches is generally constituted by a system of associated plates, whereof at least one has a certain flexibility. They are sealed into a glass envelope into which has been introduced an adequate quantity of mercury to wet the plates. The main advantage of this type of switch is that it offer a very good electrical contact, without impairing the contacting surfaces because they are wetted by mercury. However, it frequently has the disadvantage of using methods for sealing the plates in the glass envelope which are complicated and onerous, while leading to the contamination of the electrical contacts during the sealing within the glass. Moreover, it is necessary to machine the flexible plates and the dimensions required by the plates make the overall size of the switch relatively large. Finally the fact that the plates are sealed within an envelope calls for a setting or adjustment, particularly of the sensitivity. When in use the mercury vaporizes during breaks on the contacts and is partly deposited within the glass envelope, so that the amount of mercury on the contacts is reduced, so that a mercury reserve must be maintained within the envelope. As a result of this mercury reserve the operation of the switch in the envelope must be ensured in a clearly defined position in such a way that the mercury reserve present does not short-circuit the contacts.

Thus, an adaptation of the existing techniques of mercury wetted switches requires:

- a design permitting the use of the switch in such a way that it is position-independent, particularly with respect to the vertical of the location;
- a simplification of manufacturing conditions involving more particularly the elimination of contact contamination during the sealing operation, the elimination of flexible plates which need to be machined and the elimination of the actual sealing operation which is always difficult on ever-smaller devices;
- a reduction in the switch dimensions in such a way that it is possible to miniaturize the relay and automatically fit its components by means of an automatic machine.

BRIEF SUMMARY OF THE INVENTION

The only point in common between the mercury wetted switch according to the invention and switches having flexible plates is the contact opening or closing function ensured by the mercury wetted surfaces. It obviates the disadvantages of manufacturing switches in a glass envelope and of adjustment during use. It utilizes:

- a metal plate in which the flexibility is of no significance because it is movable, without requiring the use of mechanical hinges as has been done in certain known switches;
- a liquid hinge constituted by mercury or any other conductive liquid which also ensures electrical contact between the moving plate and the pivot axis constituted by two pins between which is slid one end of the plate;
- two electrical contacts, generally called the make and break contacts, formed by two pins against which abut the end of the plate opposite to that located in the liquid hinge.

Thus, the present invention relates to a magnetically controlled mercury wetted switch which comprises electrodes made from a ferromagnetic material, whose surfaces are wetted by an electricity-conducting liquid, a first electrode constituting the so-called "common" contact and at least one other electrode, wherein the passage of electrical current from the first electrode to another electrode is ensured by at least one elongated ferromagnetic material plate which moves about a liquid hinge formed by capillarity by the conductive liquid wetting the "common" electrode and the plate surface, which also bears against another electrode and is held against the latter by the action of surface tension forces, the position of the switch in space being unimportant.

BRIEF DESCRIPTION OF THE DRAWINGS

The invention is described in greater detail hereinafter relative to two non-limmitative embodiments of the mercury wetted switch according to the invention and with reference to the attached drawings, wherein show:

FIG. 1 a prior art mercury wetted switch.

FIG. 2 the basic components of the switch according to the invention, the auxiliary parts being omitted to simplify the drawing.

FIG. 3 a relay using the mercury wetted switch according to the invention in a first embodiment.

DETAILED DESCRIPTION OF THE PREFERRED EMBODIMENTS

Figure 4:
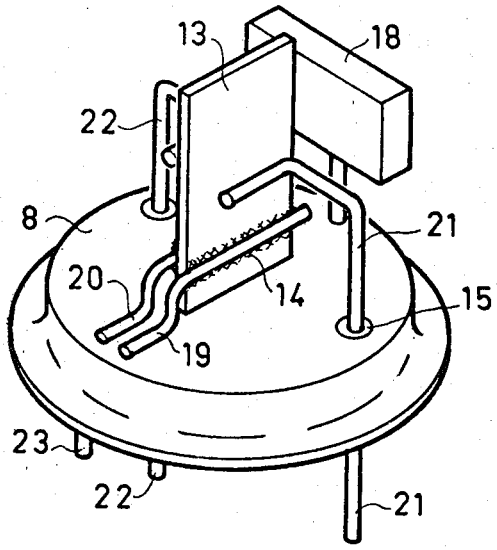
FIG. 4 the basic components of the switch according to the invention in a second embodiment.

FIG. 1 shows a mercury wetted switch as an example of the many types known from the prior art. The body 1 of said switch constitutes the common contact. Through its entire length runs a cylindrical channel and the two ends thereof are blocked by two contact pieces 2 and 3, which are held in the body and insulated by means of rings 4 or a glass-metal seal. The moving part 5 is constituted by a cylinder which moves within the perforated channel in body 1 under the action of a magnetic field. Electrical contact is ensured by a quantity of mercury 6 which is adequate for establishing a film between the moving part 5 and body 1 and for establishing contact by capillarity with one of the two end contacts 2 or 3. When the moving part moves and leaves one contact to come into bearing contact with the other contact, the mercury film breaks on the first contact and is established with respect to the second contact, because there is not sufficient mercury for electrical contact to take place at both ends of the moving part. A magnet or control coil system 7 ensures the displacements of the moving part within the switch body.

This type of switch effectively ensures wetted contacts and operates independently of its position. However, a very precise machining is necessary in order to ensure that the mercury film providing the contact between moving part 5 and body 1 is sufficiently thick to meet the capillarity requirements. However, under these conditions the moving part is relatively frequently blocked and in addition this method is onerous.

FIG. 2 shows a switch according to the invention. The drawing only shows the parts necessary to provide an understanding of its operation.

At least four electrodes 9, 10, 11 and 12 are sealed in a base 8. The moving part is constituted by a plate 13 held between wetted electrodes by a conductive liquid. The electrodes 9 and 10 are sufficiently close to one another to enable the plate to be slid between the two electrodes and held by the mercury which wets electrodes 9 and 10 and the surface of the plate, thus constituting a liquid hinge 14. The two other electrodes 11 and 12 are positioned in such a way that when the moving plate 13 moves it strikes against the electrode 11 or against electrode 12. The four electrodes 9, 10, 11 and 12 are sealed in base 8 by means of electrically insulating passages 15, generally constituted by glass powder-based fritting.

The length of moving plate 13 slightly exceeds the center-to-center distance between electrodes 9 and 10 on the one hand and 11 and 12 on the other. It is not mechanically connected to the electrodes and is only held by the surface tension forces of the conductive liquid, at one of its ends by liquid hinge 14 and at the other end by a surface tension with the electrode against which it bears. Under the action of the magnetic control field the plate is automatically recentered with respect to the electrodes of the switch.

FIG. 2 shows a cylindrical base 8 formed by the base of a discreet semiconductor box. However, the elongated base of a quartz encapsulating box is also suitable for constructing the switch according to the invention. It is important for the base to be formed from a material permitting on the one hand glass/metal sealing and on the other it must be ferromagnetic. Thus, the electrodes are sealed through the base in insulating glass beads and traverse the base in such a way that one of their ends is accessible when the relay is terminated and confined beneath a cover.

The four electrodes are also made from a ferromagnetic material in such a way that the control field can be reclosed in accordance with the general operation of magnetically controlled switches. The cover which is welded to the base when the relay is finished and adjusted is made from a non-magnetic material.

Inter alia this type of switch has two advantages. It is firstly possible to reach the electrodes in order to mechanically regulate them, particularly in view of the sensitivity required for the switch. Secondly it is possible to only chemically treat the part within the relay before welding the cover with a view to a subsequent treatment which takes place when the mercury has been introduced into the switch. Thus, a mercury wetted switch undergoes a thermal treatment which completes its manufacture. When the cover is sealed by electrical welding to the base, a quantity of mercury is introduced into the switch which has previously been mechanically treated and a pressurized gas is also introduced into the thus formed sealed enclosure in order to prevent arc formation. The hollow electrode which has served as an exhaust tube for introducing mercury and gas is then closed. The switch is then heated so as to form an amalgam between the mercury and the material deposited on the surface of the electrodes and the moving plate.

The structure of this mercury wetted switch ensures that the contacts are not contaminated during sealing, because there is no longer any glass envelope heating. Moreover, as the cover is made from a metal, the mercury can wet its inner surface, so that the switch has a considerable mercury reserve with respect to the working contact surfaces, the cover recovering the mercury which vaporizes during contact breaks, said mercury being recycled. Finally, unlike the known mercury wetted switches, the switch according to the invention operates without any jamming, because the moving plate no longer rubs against a cylindrical body or between two ceramic supports.

FIG. 2 deliberately does not show the small magnet used for polarizing the plate and contacts, while the cover has been removed, all this with the aim of making it easier to understand the drawing. A reversing switch with six fixed contacts is based on the same operating principle and represents the optical doubling of the switch of FIG. 2.

In this case electrodes 9 and 10 on which the liquid hinge 14 is formed are sealed in the center of base 8 and hold the moving plate 13, which pivots in its center instead of around one of its ends. Four electrodes are arranged symmetrically, electrodes 11 and 12 on one side of the rotation axis and 11' and 12' on the other side thereof. They are sealed and regulated in such a way that in a first position the plate is applied to two electrodes, and in a second position to two other electrodes. In the case of the present reversing switch it may be preferable for the electrodes which serve as a hinge not to be connected to the electrical mains.

FIG. 3 shows a sectional view of a finished switch according to the invention. There is once again a base 8 traversed by electrodes 9 and 10 on the one hand and 11 and 12 on the other, sealed into base 8 by glass beads 15. At least one of these electrodes 12, FIG. 3 can be hollow in order to permit the introduction of the mercury and the filling gas. The moving plate 13 is held by a liquid mercury hinge 14. A control coil 16 is positioned beneath the switch and the field of this coil is closed again on itself via electrodes 9 and 10 on the one hand and 10 and 11 on the other. The non-magnetic cover 17 is sealed by electrical welding to base 8 and a magnet 18, which is partly hidden in the drawing, polarizes the contacts. The assembly formed by the mercury wetted switch and the moving plates polarized by a magnet inside or outside the cover and controlled by a coil 16 constitutes a relay.

This relay can also be operated without a magnet 18 by means of two coils, each attracting plate 13 in one position.

FIG. 4 shows the switch according to the invention in a second embodiment.

In this embodiment the switch still has a base 8 to which are welded two pins constituting the hinge about which the moving plate pivots. The two pins 19 and 20 are then welded and positioned in accordance with a plane parallel to the upper plane of the base. The moving plate 13 pivots around a liquid hinge 14, which is no longer perpendicular to the upper plane of the base and is instead parallel thereto. The two electrodes 21 and 22 are bent so as to ensure contact with moving plate 13 in accordance with generatrixes which are also parallel to the upper face of the base. The make and break electrodes 21 and 22 are also sealed into the base by means of the glass beads 15. The polarizing magnet 18 is held by any appropriate means, but can be fixed to the base by a welded pin 18*a*. Electrodes 21 and 22 traverse the base, which also has a third output pin 23 electrically corresponding to the contacts with the plate, i.e. the common contact. Moving plate 13 is maintained in space by the capillarity of the liquid hinge 14.

Figure 5:
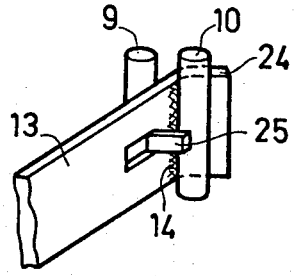
FIG. 5 a first improvement of the invention.

FIG. 5 shows a first improvement of the invention providing shock or impact stabilization for the plate. It has been stated hereinbefore that the plate, which is not mechanically connected to the electrodes, is automatically recentered by the magnetic control field of the switch. However, in order to comply with certain equipment requirements, e.g. shock resistance, the invention provides a first anti-shock improvement. In FIG. 5 plate 13 is shown between two electrodes 9 and 10 against which it is held by a liquid hinge 14. On one side of the electrodes the plate is bent at 24 preventing it from sliding in a first direction. Moreover, on the other side of the electrodes it has a member 25 which is turned down substantially perpendicular to the moving plate. Parts 24 and 25 of the plate are spaced in such a way that it retains a degree of freedom adequate for holding the same, without however requiring any adjustment of the assembly.

Figure 6:
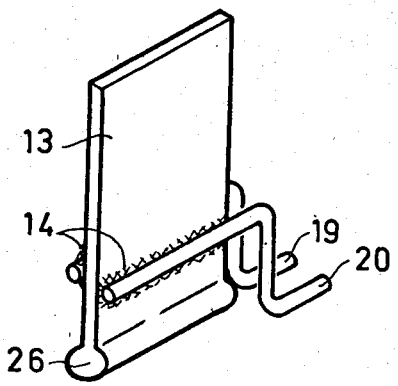
FIG. 6 a second improvement of the invention.

FIG. 6 shows a second improvement of the invention which balances the plate if shocks or impacts occur during operation.

One of the problems with conventional mercury wetted switches is their sensitivity to shocks and impacts during operation as a result of the asymmetry of the plates. In the mercury wetted switch according to the invention most of the plate is located on the same side of the liquid hinge. The improvement of FIG. 6 consists of balancing the mass of plate 13 pivoting about a liquid hinge 14 by a moulded, welded or remelted mass 26 located on the other side of hinge 14 with respect to the main mass of plate 13. This improvement has an advantageous effect with respect to shocks occurring during operation, because the mass 26 prevents plate 13 from sliding between electrodes 19 and 20.

Hereinbefore the liquid hinge 14 has been described as being formed by capillarity of the conductive liquid between two electrodes 9 and 10 or 19 and 20, depending on the drawings. Thus, the liquid hinge 14 can be formed between the plate on the one hand and a single electrode constituted either by a pin which is curved on to itself in the form of a hairpin or a part machined into the shape of a fork.

The switch according to the invention and the relay produced from this switch have a certain number of advantages, including its very high sensitivity, i.e. its operation under a low current, while being insensitive to impacts and to the operating position. Moreover, it is pointed out that it is easy to manufacture, without requiring high levels of precision in the construction of parts. The setting or adjustment of the electrodes or the sensitivity can be performed on the switch during manufacture before sealing it in a tightly sealed box or case. It is formed from base members, which are readily available, because they are of the type used in semiconductor devices. Such a mercury wetted switch and such a relay can be widely used in industry and particularly in the telephone industry and in the construction of electronic stations.

What is claimed is:

1. A switch comprising: a base having a planar surface, a cover placed over said planar surface so as to define therewith a closed space, a plurality of electrodes of ferro-magnetic material passing through said base and surface into said space, electrically insulating glass/metal welds surrounding said electrodes in said base to seal said electrodes with respect thereto, the planar surface of said base and the interior surface of said cover and the surfaces of said electrodes inside said space being wetted by an electrically conducting liquid, said welds being the only surfaces of said space not wetted by said liquid, one of said plurality of electrodes forming a common contact, at least one elongated plate of ferro-magnetic material arranged in said space and extending substantially perpendicular to said planar surface of said base, said plate being movable about a liquid hinge formed by capillarity by the conductive liquid wetting the common electrode and plate surface, said plate being adapted to bear against said at least one other electrode and to be held thereagainst by surface tension so that electrical current may pass from said common electrode to said at least one other electrode.

2. A switch according to claim 1, comprising two metal members provided adjacent the plate at the liquid hinge which are turned down perpendicular to the planar surface and on either side of the common electrode, and whose function it is to make the switch insensitive to shocks and impacts, the plate also being adapted to be automatically recentered on the electrodes by a magnetic control field during operation.

3. A switch according to claim 1, wherein the plate has a counterweight at its end located on the side of the liquid hinge away from the other electrodes.

4. A switch according to claim 1, wherein at least one of the electrodes is constituted by a tube for introducing conductive liquid and pressurized gas into said space.

5. A switch according to claim 1, wherein said hinge extends perpendicularly to said planar surface.

6. A switch according to claim 1, wherein said hinge extends parallel to said planar surface.

7. A switch according to claim 1, wherein said base is essentially cylindrical and of magnetic material, said core being of non-magnetic material, said liquid is mercury, and said one electrode is composed of two pins between which said plate extends, with mercury forming said hinge.

8. A switch according to any one of claims 1 to 7, in combination with an electrical relay, having a contact polarizing magnet, and at least one magnetic control coil.

9. The combination according to claim 8, wherein the polarizing magnet is a magnetic control coil.

* * * * *